US007134226B2

(12) United States Patent
Robinson, Jr. et al.

(10) Patent No.: US 7,134,226 B2
(45) Date of Patent: Nov. 14, 2006

(54) CLEAT ASSEMBLY FOR GOLF SHOE

(75) Inventors: Douglas K. Robinson, Jr., Mansfield, MA (US); John J. Erickson, Brockton, MA (US); Richard A. Mochen, Milton, MA (US); Hetal M. Parekh, Framingham, MA (US)

(73) Assignee: Acushnet Company, Fairhaven, MA (US)

( * ) Notice: Subject to any disclaimer, the term of this patent is extended or adjusted under 35 U.S.C. 154(b) by 179 days.

(21) Appl. No.: 10/943,312

(22) Filed: Sep. 17, 2004

(65) Prior Publication Data

US 2006/0059723 A1 Mar. 23, 2006

(51) Int. Cl.
*A43B 5/00* (2006.01)

(52) U.S. Cl. ..... 36/134; 36/127

(58) Field of Classification Search ..... 36/134, 36/127, 67 D

See application file for complete search history.

(56) References Cited

U.S. PATENT DOCUMENTS

| | | | | | |
|---|---|---|---|---|---|
| 5,926,980 | A * | 7/1999 | Adam | 36/134 |
| 5,940,993 | A | 8/1999 | Ronci | 36/134 |
| 5,979,083 | A | 11/1999 | Robinson et al. | 36/127 |
| 6,023,860 | A | 2/2000 | McMullin | 36/127 |
| 6,138,386 | A | 10/2000 | Singer et al. | 36/127 |
| 6,154,984 | A * | 12/2000 | Adam | 36/134 |
| 6,167,641 | B1 | 1/2001 | McMullin | 36/127 |
| 6,233,850 | B1 | 5/2001 | Peabody | 36/134 |
| 6,305,104 | B1 | 10/2001 | McMullin | 36/127 |
| 6,381,878 | B1 | 5/2002 | Kennedy, III et al. | 36/134 |
| 6,474,003 | B1 | 11/2002 | Erickson et al. | 36/100 |
| 6,481,122 | B1 * | 11/2002 | Brahler | 36/134 |
| 6,502,332 | B1 | 1/2003 | Nakayama | 36/134 |
| 6,708,426 | B1 | 3/2004 | Erickson et al. | 36/127 |
| 2002/0152643 | A1 * | 10/2002 | Kim | 36/127 |

* cited by examiner

*Primary Examiner*—Ted Kavanaugh
(74) *Attorney, Agent, or Firm*—D. Michael Burns

(57) ABSTRACT

The present invention is directed to a four-component releasable mounted cleat assembly for interlocking into a receptacle of an athletic shoe wherein an inner rotating component may reciprocally swivel within an outer stationary component. The outer stationary component having a plurality of rigid posts extending outward for firmly gripping turf. The inner rotating component has a plurality of resilient legs extending outward in a radial direction for rotatably gripping the turf, wherein each leg may swivel in clockwise and counter-clockwise directions about 15° in relationship to the outer stationary component. The cleat assembly has a locking component which is biasly rotated in a first direction to install it within the shoe receptacle, and a geometric construction of downwardly extending tongues causes a requirement for a greater torque remove the cleat than was necessary to install it. A connecting component passes through the entire cleat assembly and secures the rotating, stationary and locking components together into a unitary cleat assembly.

24 Claims, 4 Drawing Sheets

CLEAT ASSEMBLY FOR GOLF SHOE

FIELD OF THE INVENTION

This invention relates generally to athletic shoes, and more particularly to releasable mounted cleats for the use on outsoles of athletic and golf shoes. More specifically, the cleats are of a four-component design with an inner rotating component swiveling within an outer stationary component.

BACKGROUND OF THE INVENTION

Damage to golf greens, as well as to the wooded floors and carpets of golf clubhouses, caused by golfers wearing athletic shoes with metal spikes is a well-known phenomenon. The need for improved traction on turf surfaces must be tempered with the adverse affect that large metal spikes have upon the turf of golf courses, especially the putting green surface. The protruding metal spike common to golf shoes has systematically been replaced by alternative spike and traction cleats which provide less damage to golf courses. In fact, many golf courses have completely banned the use of metal spikes. Besides the aggravation that golfers feel when having to putt through spike marks left on the putting surface, metal spikes affect groundskeepers who at the end of the day must spend numerous hours repairing the putting greens.

In response to alleviating the foregoing problems which are intrinsic to metallic spikes, shoe manufacturers are providing golf shoes having non-metallic cleats (plastic spikes). The need for improved traction on turf surfaces is well known and it is often perceived by many users that plastic cleats are less proficient than metal spikes in ground gripping ability, thus there is a great need for a plastic cleat with superior traction, not just on a golf course, but safety traction on non-grass and non-sand terrain, such as steps, asphalt, tile oak and other types of flooring which golfers have to transverse. Plastic cleats generally have protrusions which are shorter than conventional metallic spikes and thereby provide wearers with improved comfort since such cleats absorb shocks from hard surfaces to a certain degree. Plastic cleats also provide improved stability because they are shorter and have a larger number of contact points than shoe soles with conventional metallic spikes. However, as previously stated, such conventional plastic cleats do not generally provide as good grip or bite on grass or turf as metallic spikes do, and providing good grip on grass is what is expected of cleats and spikes. Conventional plastic cleats especially fail against metal spikes in providing grip on wet grass, withered grass or slopes. The plastic cleats are known to be far more difficult to keep clean, which is a primary concern of golfers playing in adverse weather conditions. Some manufacturer's recognize this problem and supply special cleaning tools for keeping the spikes clean of debris. The present invention presents an improved plastic cleat that provides a solution for these problems.

SUMMARY

In accordance with one aspect of this invention, a four-component cleat assembly is presented that includes a locking component, a stationary component, a rotating component and a connecting component. The locking component interlocks with an open receptacle located in the sole of an athletic shoe or more specifically a golf shoe. The rotating component is coupled to the stationary component and can swivel a predetermined distance (about 15°) both clockwise and counter-clockwise within the stationary component, which aids in keeping debris from piling up and clogging the cleat.

The invention includes a plurality of relatively hard and rigid posts that extend from the stationary component and firmly grip the turf, and also included are a plurality of resilient legs that extend outward in a radial direction from the rotating component and also grip the turf. Each leg rotates (swivels) in a distance determined by the fit of the rotating component to the stationary component, wherein the cleat assembly may provide a golfer with an improved translational range of motion while maintaining firm traction with the ground.

Another aspect of the invention is a connecting component having an elongated cylindrical body of a size to squeeze-fit through central openings that are defined in each of the rotating, stationary and locking components thus connecting all the components into a single operative cleat. The connecting component has a cam edge dimensioned to fit into a cam-shaped orifice defined in the rotating member. A slotted groove at the opposite end of the connecting component aids in squeeze-fitting through the components.

Another aspect of the invention provides for an interlocking of the cleat assembly to the open receptacle of the shoe by having an insertion element extend from the locking component. This insertion element screws into the receptacle while a plurality of spaced apart flexible frangible lock tongues, which extend downward about a bottom surface edge of the disk, compression-fit within the open receptacle of the shoe. When the locking component is rotated in a first direction within the open receptacle, each of the lock tongues are biased into a retracted position against the open receptacle and then re-extend themselves once the locking component has been rotated in the first direction through about 60 degrees. The lock tongues have a cam surface to aid in screwing the cleat into the receptacle and they have a vertical surface that insures that a greater force must be applied to remove the cleat assembly than to install it.

DETAILED DESCRIPTION OF THE INVENTION

Figure 1:
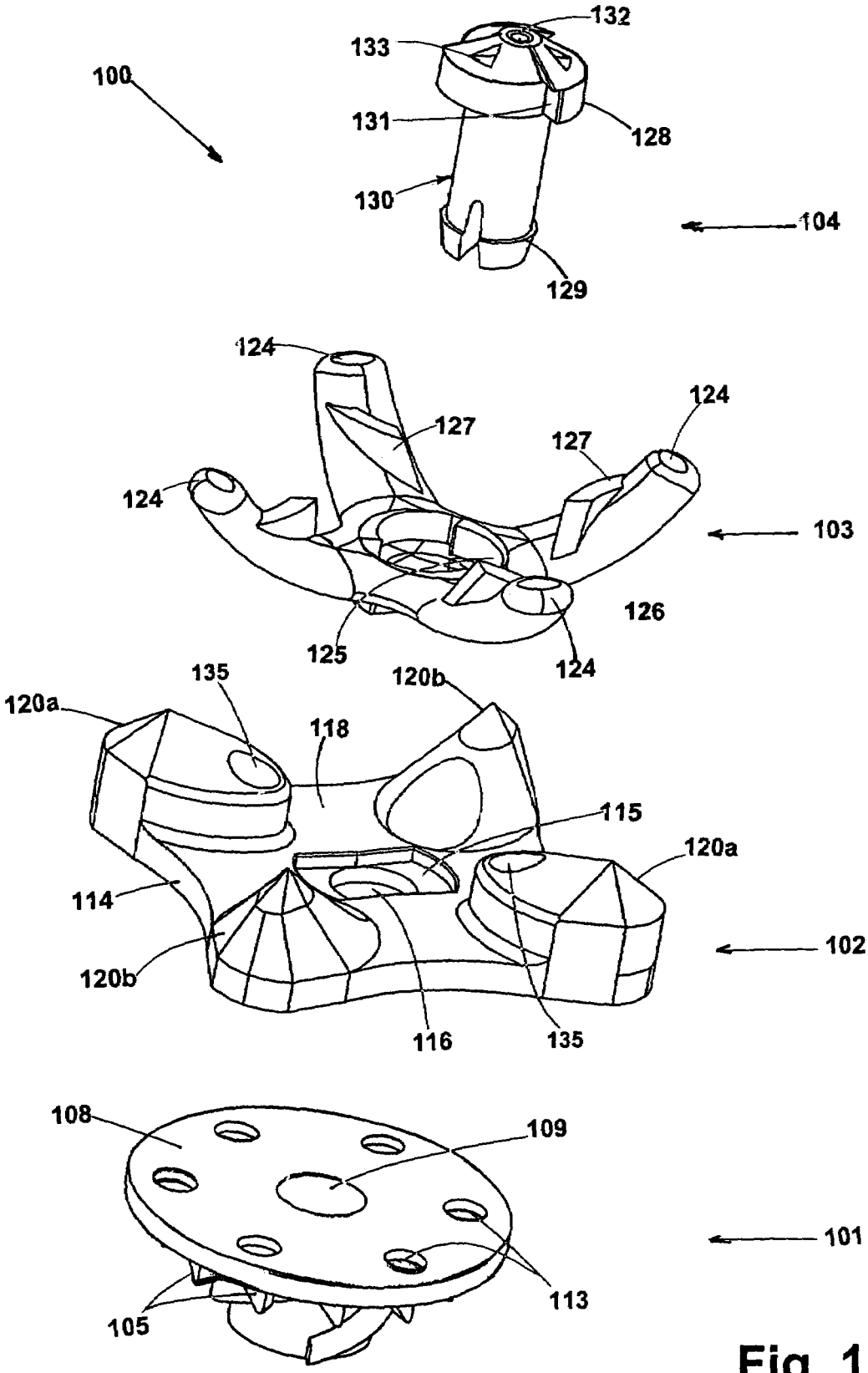
FIG. 1 is an exploded view of a four-component cleat assembly for golf shoes, wherein the cleat assembly is shown in its position reversed upside down (in the drawings, for convenient description).

Referring now to the drawings, an improved cleat assembly (also referred to as "cleat") is indicated generally by the reference numeral 100. The cleat assembly 100 comprises four components: a locking component 101, which is adapted for interlocking with an open receptacle on an athletic shoe, preferably a golf shoe (the attaching mechanism of the shoe is not shown but examples of the shoe and receptacle pattern are presented in U.S. Pat. Nos. 6,708,426 and 6,474,003, both of which are herein referenced in their entirety); an outer stationary component 102 having means discussed later for engaging the turf; an inner rotating component 103, which alternately reciprocates between elements of the stationary member 102; and a connecting component 104 which penetrates and secures all the other components into a single cleat assembly 100. The outer stationary and inner rotating components 102 and 103 are preferably fabricated from a pliable thermoplastic urethane having a Shore A hardness in the range of 80 to 100 with 98 preferred. The locking component 101 is preferably made of a firm thermoplastic or nylon with a hardness of about 70D, and connecting component 104 is preferably made of a more rigid plastic such as nylon 70D.

Figure 2:
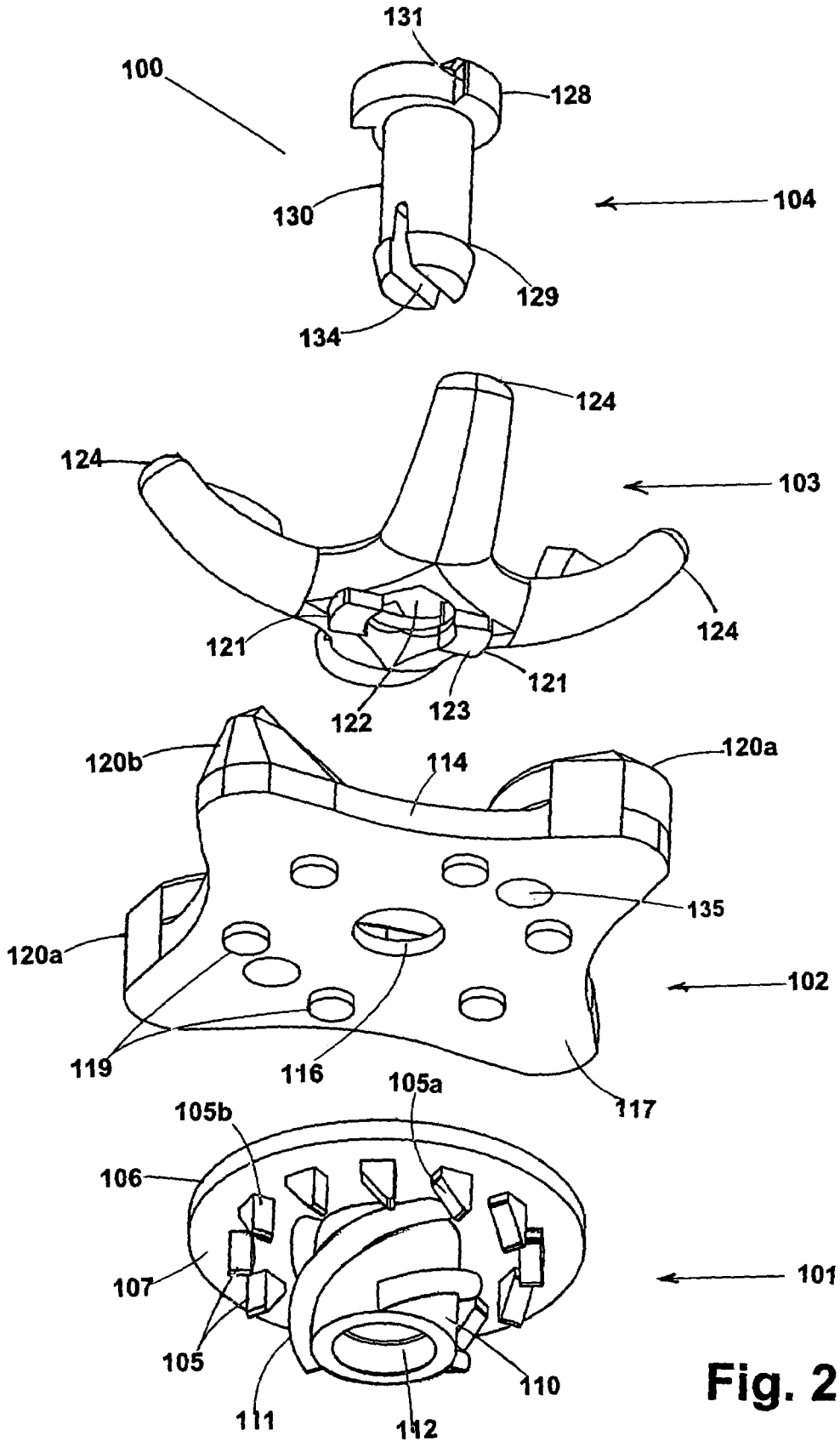
FIG. 2 is an exploded view of the four-component cleat assembly of FIG. 1, shown in a perspective view opposite the view of FIG. 1.
Figure 5:
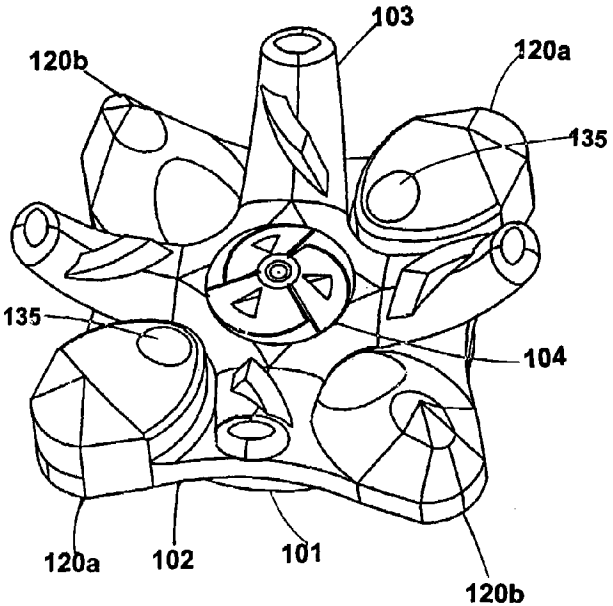
FIG. 5 is a perspective view of the assembled cleat assembly of FIG. 3.
Figure 4:
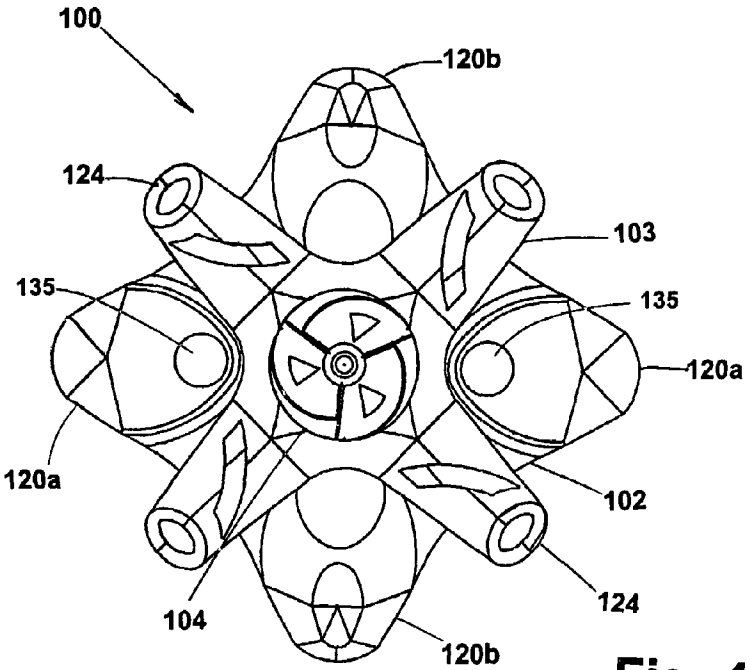
FIG. 4 is a plan view of the turf gripping side of the four-component cleat assembly when in an assembled state.
Figure 3:
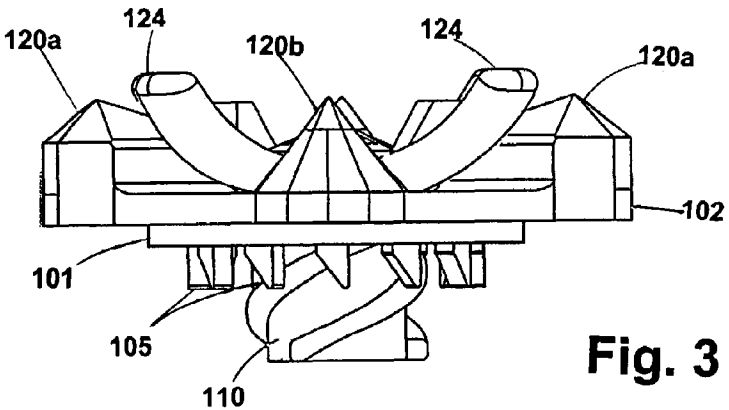
FIG. 3 is an elevation view of the cleat assembly of FIG. 1, also in a reversed position.
Figure 6:
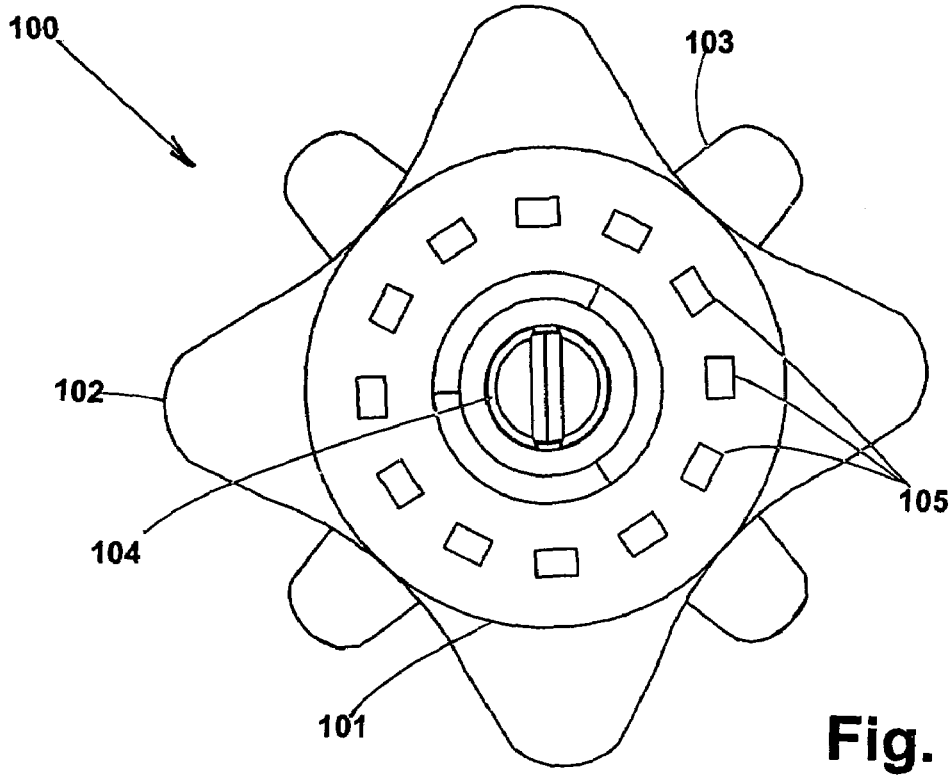
FIG. 6 is a plan view of the attachment side of the cleat assembly of FIG. 1.
Figure 7:
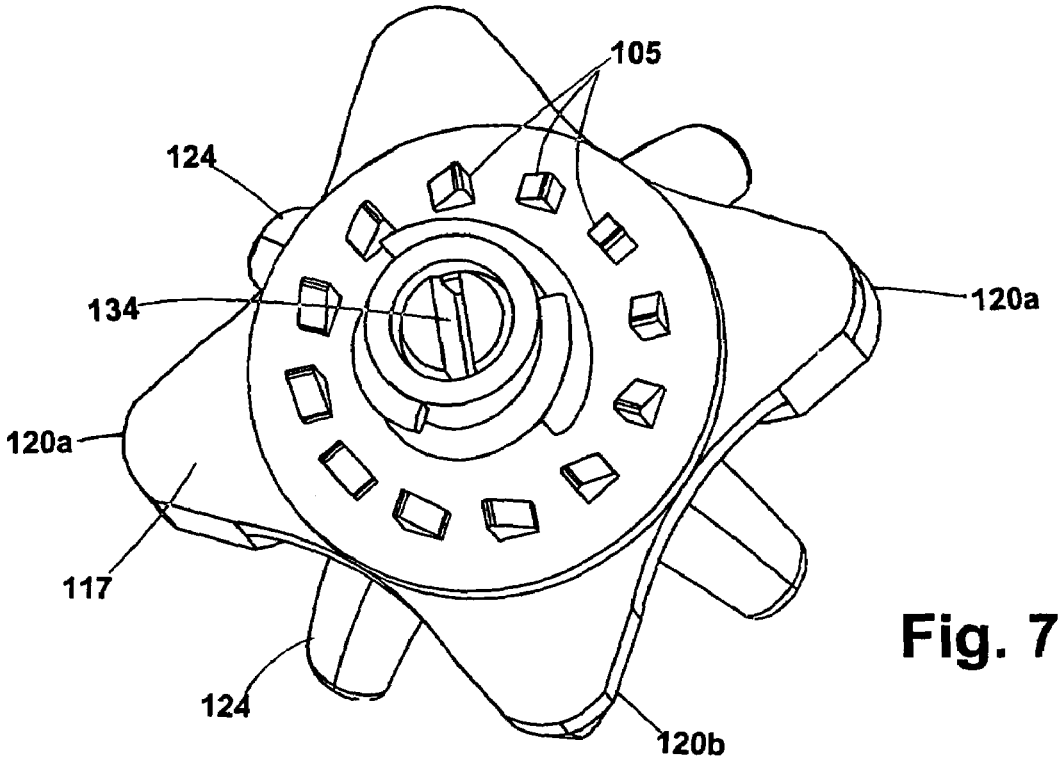
FIG. 7 is a perspective view of the cleat assembly of FIG. 6.

As is illustrated in FIGS. 1 to 7, the locking component 101 in the cleat assembly 100 may be engaged within one of a plurality of open receptacles (not shown) which are mounted in the sole of an athletic shoe, and for purposes of this disclosure the athletic shoe will herein be referred to as a golf shoe. The number of open receptacles in the golf shoe may vary, but a preferable number would be about five or seven in the forefoot section and about two or four in the heel section. For purposes of clarity, this specification denotes "bottom" as the side of the cleat assembly 100 that is attached to the sole of the shoe, and "top" as the side of the cleat assembly 100 that engages the turf.

The locking component 101 has a generally circular disk 106 with a bottom surface 107 and a flat top surface 108, and a round opening 109 defined approximately in the center of the disk 106 for receiving the connecting component 104 in a friction fit. Locking component 101 further has a cylindrically shaped insertion element 110 that contains a spiraling thread 111 for screwing into one of the open receptacles of the golf shoe. Insertion element 110 has a generally circular internal chamber 112 defined in the center section for housing the connecting component 104. The diameter of the chamber 112 is approximately the same size as the round opening 109 at the top surface which receives the connecting component 104. A golf cleat tool (well known in the industry and therefore not shown) is usually preferred for installing and removing of the cleat assembly 100 in the shoe receptacle. Once inserted into the receptacle, the cleat assembly 100 is rotated clockwise about a centerline of the insertion element 110 through to an angle of approximately 60 degrees wherein it is locked into position. The locking component 101 also includes a plurality of flexible lock tongues 105 that extend in a spaced manner outwardly about the outer edge of a bottom surface 107 of the disk 106. The original shape of each lock tongue 105 includes a cam surface 105*a* and a non-cam vertical surface 105*b*. When the cleat 100 is initially being screwed into the shoe receptacle, the lock tongues 105 are of a dimension and size that they just clear a side rib in the shoe receptacle (not shown). After cleat 100 has been screwed on a slight amount further, then the lower edge of the locking component 101 is just above the upper rim of the shoe receptacle, and the lock tongues 105 are then deformed by a cam action provided by the lock tongue cam surfaces 105*a* which "ride" over projections that are in the shoe receptacle. Upon being further turned, the lock tongues 105 pass the projections in the receptacle until a tight fit is achieved, they then restore themselves (to some extent) to their original shape. Each expendable tongue 105 will pass against, be deformed by, and pass over a number of receptacle projections. The interference between projections in the receptacle and the lock tongues 105 holds the cleat 100 in place during shoe use. When the insertion element 110 has been fully rotated, these lock tongues 105 re-extend themselves into appropriate pockets disposed in the shoe receptacle. The construction of these receptacles conforms to the dimensions of the lock tongues 105. The geometric construction and locking action provided by this interaction requires one to apply greater torque to remove the cleat assembly 100 than to install it.

The stationary component 102 has a generally rectangular base 114 with a generally rectangular slot 115 in the center of the base 114, and a smaller circular opening 116 penetrating through the center of the base 114. As with the locking component 101, the smaller circular opening 116 provides for a friction-fit with the connecting component 104, while the larger rectangular slot 115 is sized to receive the rotating component 103. Extending perpendicularly away from the bottom side 117 of the base 114 are a plurality of spaced apart cylindrically shaped dowels 119 of a size, shape and number to be friction-fitted into a like number of circular recesses 113 located about the edge of the top surface 108 of the locking component 101. This will prevent lateral movement between the locking component 101 and the stationary component 102. The base 114 also features a plurality of posts, preferably four, located at the corners of the base 114 and extending away from the top surface 118 so as to provide for rigid attachment to the turf. The posts include two larger posts 120*a* and two smaller posts 120*b*. The smaller posts 120*b* have more acutely pointed tips that start angling at the base 114. The larger posts 120*a* have an outer exterior generally perpendicular to the top surface 118 and a larger area for contacting the turf. Each larger post 120*a* also has an opening 135 for insertion of a tine of the cleat tool. The outermost exteriors of the posts, 120*a* and 120*b*, do not extend beyond the dimensions of the base 114 and the posts are quite rigid and generally non-deflecting.

A major improvement provided by the present invention is the construction of the inner rotating component 103. This component includes a pair of heel-shaped plates 121 having flat bottom faces 123 of a size and shape for fitting into the rectangular slot 115 of the outer stationary component 102, such that the inner rotating component 103 may swivel in both clockwise and counter-clockwise directions to about 15° in each direction when in relationship to the stationary component 102. Defined in the center of the plate 121 is an opening 122 of a size for friction-fitting the connecting component 104. Also defined in the top face 126 of the plate 121 is a cam-shaped orifice 125 for housing and securing the connecting component 104. Extending radially outward from the top face 126 are a plurality of arcuately shaped resilient legs 124, preferably four, for contacting the turf. The legs 124 have a freedom of movement whereby they may translate reciprocally a distance of about 15° within the outer stationary component 102, and they may rotate in either a clockwise or a counterclockwise direction. Each leg 124 has a wing-shaped spoiler 127 to aid in the debris removing process. The translating movement allows a golfer an increased range of motion and also helps to prevent a build-up of turf that clogs the cleat assemble 110.

The connecting component 104 has an elongated cylindrical body 130 of a size and shape configured to friction-fit through the rotating, stationary and locking components 103, 102, and 101, respectively to secure all components into a unitary cleat assembly 100. The top end 128 of the connecting component 104 has a cam-shaped edge 131, which is dimensioned to fit within the cam-shaped orifice 125 of the rotating component 103, yet still not impede any translating movement of the rotating component 103. Also at the top end 128 are a plurality of slots 133, preferably four, which may provide an additional measure of traction. At the top center 132 of connecting component 104 an area for placement of a logo or other indicia is provided. A slotted groove 134 is formed in the insertion end of the connecting component 104 to aid in the friction-fitting through the other components 103, 102, and 101. A lip 129 is located at the insertion end to secure the components when the connection component 104 is fully extended through the cleat assembly 100.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

We claim:

1. A removable cleat assembly adapted for interlocking with an open receptacle on a golf shoe, the cleat assembly comprising:

an outer stationary component;

a locking component for interlocking the outer stationary component to the open receptacle;

an inner rotating component;

a connecting component for connecting the inner rotating component to an outer stationary component, wherein the inner rotating component can rotate both clock-wise and counter-clockwise in relationship to the outer stationary component.

2. The cleat assembly according to claim 1, wherein the locking component comprises:

a generally circular disk having a centrally located round opening;

an insertion element extending perpendicularly downward from a bottom surface of the disk, the insertion element having a spiraling thread for screwing into the open receptacle of the golf shoe, a plurality of flexible lock tongues extending in a spaced manner downward about an edge of a bottom surface of the disk for compression-fitting within the open receptacle of the shoe, the lock tongues having a cam surface and a vertical surface, wherein as the locking component is rotated in a first direction within the open receptacle, each of the lock tongues are biased into a retracted position against the open receptacle and then restore themselves once the locking member has been rotated in the first direction through about 60 degrees, such that a greater force must be applied to remove the cleat assembly than to install it.

3. The cleat assembly according to claim 2, wherein the locking component is made from a firm thermoplastic or nylon with a hardness of about 70D.

4. The cleat assembly according to claim 2, wherein the outer stationary component comprises:

a base having a centrally located round opening;

a slot defined in a top side of the base;

a plurality of dowels extending perpendicularly away from a bottom side of the base, the dowels being of a size, shape and number for friction-fitting into a plurality of recesses spaced about the outer edge of a top surface of the locking component, wherein lateral movement between the locking component and stationary component is prevented; and a plurality of rigid posts extending outward from the top side of the base, the outer dimensions of the posts maintained within the perimeter of the base.

5. The cleat assembly according to claim 4, wherein the plurality of posts comprises two larger posts and two smaller posts, each post located at a corner of the base.

6. The cleat assembly according to claim 4, wherein the inner rotating component comprises:

a pair of heel-shaped plates having generally square flat bottom faces, the plates of a size and shape for rotationally fitting into the slot of the outer stationary component, wherein the inner rotating component can reciprocally swivel clock-wise and counter clock-wise;

a centrally located round opening defined in the plate;

an orifice defined in a top face of the plate, the orifice having a cam-shaped perimeter; and a plurality of resilient legs extending outwardly in a radial direction from the top face, the legs designed for swivel contact with turf, wherein each leg may reciprocally swivel clockwise and counterclockwise about 15° in each direction in relationship to the outer stationary component.

7. The cleat assembly according to claim 6, wherein the plurality of resilient legs are arcuately shaped.

8. The cleat assembly according to claim 6, wherein the plurality of resilient legs are four.

9. The cleat assembly according to claim 6, wherein each of the resilient legs is disposed between adjacent posts.

10. The cleat assembly according to claim 6, wherein each of the resilient legs has a wing shaped spoiler to aid in the removal of debris from the cleat.

11. The cleat assembly according to claim 6, wherein the inner rotating component is made from a pliable thermoplastic urethane having a Shore A hardness in a range from 80 to 100.

12. The cleat assembly according to claim 6, wherein the connecting component comprises:

an elongated body of a size and shape to friction-fit through centrally located openings of the locking, outer stationary and inner rotating components to interconnect the components therein; and a top end having a cam-shaped edge dimensioned to fit within the cam-shaped perimeter of the orifice in the rotating component.

13. The cleat assembly according to claim 12, wherein a slotted groove is defined in the bottom end of the connecting component for aiding the friction-fitting through the inner rotating, outer stationary, and locking components.

14. A four-component cleat assembly, the cleat assembly comprising:

(a) a locking component including:

a disk having a centrally located opening defined therein and a plurality of recesses located about a top surface edge of the disk, and an insertion element for inserting the locking component within an open receptacle of an athletic shoe;

(b) an outer stationary component comprising:

a base having a centrally located opening defined therein, a slot defined in a top side of the base, a plurality of dowels in a spaced manner extending perpendicularly downward from a bottom side of the base, the dowels being of a size and configuration to friction-fit within the plurality of recesses of the locking component, wherein any lateral movement of either the stationary component to the locking component is prevented, and a plurality of rigid posts extending upwards from the top surface of the base for providing firm attachment to turf;

(c) an inner rotating component comprising:

a pair of opposing heel-shaped plates spaced apart to define a centrally located opening therein, the plates of a size, shape and spacing to rotatably fit into the slot of the stationary component, a cam shaped orifice defined in a top face of the plate, a plurality of resilient legs extending outwardly in a radial direction from a top face of the plate, each leg located between a pair of posts, and wherein each leg may rotate such that it reciprocates clockwise and counterclockwise about 15° in the slot of the stationary component; and (d) a connecting component comprising:

an elongated cylindrical body of a size to friction-fit through the central openings of the rotating, stationary and locking components, and a top end of the connecting component, having an edge dimensioned to fit into the cam shaped orifice perimeter of the rotating component.

15. The cleat assembly according to claim 14, wherein the insertion element comprises:

the insertion element extending perpendicularly downward from a bottom surface of the disk, for screwing into the open receptacle in the athletic shoe and a plurality of spaced flexible lock tongues extending downward about a bottom surface edge of the disk for compression-fitting within the open receptacle of the shoe, wherein as the locking component is rotated in a first direction within the open receptacle, each of the lock tongues are biased into a retracted position against the open receptacle and then re-extending themselves once the locking component has been rotated in the first direction through about 60 degrees, such that a greater force must be applied to remove the cleat assembly than to install it.

16. The cleat assembly according to claim 14, wherein the plurality of posts comprises two larger posts and two smaller posts, each post located at a corner of the base.

17. The cleat assembly according to claim 14, wherein the plurality of resilient legs is four, each one disposed between a pair of adjacent posts.

18. The cleat assembly according to claim 14, wherein the athletic shoe is a golf shoe.

19. A golf shoe comprising:

an upper;

a sole connected to the upper and having a plurality of open receptacles;

a plurality of removable cleats, each one interlocking with a receptacle; and each cleat comprising:

a locking component for interlocking the cleat to the receptacle;

an inner rotating component;

an outer stationary component; and a connecting component for connecting the inner rotating component to the outer stationary component, wherein the inner rotating component can rotate both clock-wise and counter-clockwise in relationship to the outer stationary component.

20. The golf shoe according to claim 19, wherein the the locking component comprising:

a generally circular disk having a centrally located round opening;

an insertion element extending perpendicularly downward from a bottom surface of the disk, the insertion element having a spiraling thread for screwing into the receptacle of the golf shoe, a plurality of flexible lock tongues extending in a spaced manner downward about an edge of a bottom surface of the disk for compression-fitting within the open receptacle of the shoe, the lock tongues having a cam surface and a vertical surface, wherein as the locking component is rotated in a first direction within the receptacle, each of the lock tongues are biased into a retracted position against the open receptacle and then restore themselves once the locking member has been rotated in the first direction through about 60 degrees, such that a greater force must be applied to remove the cleat than to install it.

21. The golf shoe according to claim 20, wherein the outer stationary component comprises:

a base having a centrally located round opening;

a slot defined in a top side of the base;

a plurality of dowels extending perpendicularly away from a bottom side of the base, the dowels being of a size, shape and number for friction-fitting into a plurality of recesses spaced about the outer edge of a top surface of the locking component, wherein lateral movement between the locking component and stationary component is prevented; and a plurality of rigid posts extending outward from the top side of the base, the outer dimensions of the posts maintained within the perimeter of the base.

22. The golf shoe according to claim 21, wherein the plurality of posts comprises two larger posts and two smaller posts, each post located at a corner of the base.

23. The golf shoe according to claim 22, wherein the inner rotating component comprises:

a pair of heel-shaped plates having generally square flat bottom faces, the plates of a size and shape for rotationally fitting into the slot of the outer stationary component, wherein the inner rotating component can reciprocally swivel clock-wise and counter clock-wise;

a centrally located round opening defined in the plate;

an orifice defined in a top face of the plate, the orifice having a cam-shaped perimeter; and a plurality of resilient legs extending outwardly in a radial direction from the top face, the legs designed for swivel contact with turf, wherein each leg may reciprocally swivel clockwise and counterclockwise about 15° in each direction in relationship to the outer stationary component.

24. The golf shoe according to claim 23, wherein the connecting component comprises:

an elongated body of a size and shape to friction-fit through centrally located openings of the locking, outer stationary and inner rotating components to interconnect the components therein; and a top end having a cam-shaped edge dimensioned to fit within the cam-shaped perimeter of the orifice in the rotating component.

* * * * *